United States Patent [19]

Gabrielli

[11] Patent Number: 4,523,392

[45] Date of Patent: Jun. 18, 1985

[54] INNER LINING FOR SPORTS FOOTWEAR HAVING A RIGID OR SEMI-RIGID SHELL STRUCTURE

[75] Inventor: Andrea Gabrielli, Predazzo, Italy

[73] Assignee: Lange International S.A., Fribourg, Switzerland

[21] Appl. No.: 461,020

[22] Filed: Jan. 26, 1983

[30] Foreign Application Priority Data

Feb. 22, 1982 [CH] Switzerland ..... 1072/82

[51] Int. Cl.[3] ..... A43B 19/00

[52] U.S. Cl. ..... 36/10; 36/88; 2/DIG. 6

[58] Field of Search ..... 36/10, 117, 118, 119, 36/120, 121, 12, 88; 2/DIG. 6

[56] References Cited

U.S. PATENT DOCUMENTS

| | | | |
|---|---|---|---|
| 3,239,952 | 3/1966 | Lange et al. | 36/120 |
| 3,593,435 | 7/1971 | Lange | 36/2.5 |
| 3,858,337 | 1/1975 | Vogel | 36/55 |
| 3,977,098 | 8/1976 | Chalmers | 36/89 |
| 4,038,762 | 8/1977 | Swan | 36/117 |
| 4,083,127 | 4/1978 | Hanson | 36/117 |
| 4,302,847 | 12/1981 | Miles | 2/2 |
| 4,433,494 | 2/1984 | Courvoisier | 36/119 |

FOREIGN PATENT DOCUMENTS

| | | | |
|---|---|---|---|
| 0004829 | 10/1979 | European Pat. Off. . | |
| 820706 | 7/1949 | Fed. Rep. of Germany | 36/119 |
| 2106728 | 5/1972 | France . | |
| 2342039 | 8/1976 | France . | |
| 48-80739 | 10/1973 | Japan . | |

OTHER PUBLICATIONS

Gershman, *American Medical Ass.* vol. 168, No. 7, "Self-Adhering Nylon Tapes" Oct. 1958, p. 980.

*Primary Examiner*—Werner H. Schroeder
*Assistant Examiner*—Mary A. Ellis
*Attorney, Agent, or Firm*—Brumbaugh, Graves, Donohue & Raymond

[57] ABSTRACT

This lining consists of an assembly of flexible panels assembled to constitute a kind of slipper having two lateral pockets opening to the rear for introducing a one-piece padding into the pockets, this padding extending to the rear on either side of the lining. The two lateral pockets extend on both sides in the front portion of the lining and comprise at the rear a substantially vertical opening. Furthermore, the lining comprises an outer one-piece sheathing covering the lower rear portion of the upper, the heel and the lateral portions at the rear of the two front lateral pockets. This sheathing is fastened permanently to the upper along its upper edge and detachably, at least through its vertical edges, to the other portions of the lining, so as to cover the edges of the openings of the two front lateral pockets. The one-piece padding is detachably housed under the sheathing and in the lateral pockets.

3 Claims, 4 Drawing Figures

INNER LINING FOR SPORTS FOOTWEAR HAVING A RIGID OR SEMI-RIGID SHELL STRUCTURE

BACKGROUND OF THE INVENTION

The present invention relates to an inner lining for sports footwear having a rigid or semi-rigid shell structure, the lining consisting of an assembly of flexible panels assembled with one another to constitute a kind of slipper having two lateral pockets openings at the rear to permit the insertion therein of a one-piece padding member extending behind the upper and on either side of the lining.

In order to reduce at retailers' shops the stocks of bodies or shells incorporated in certain types of sports footwear, notably ski boots and hockey skate boots, a known proposition consists in utilizing inner linings for enabling the retainer to fit various boot sizes and widths.

THE PRIOR ART

Thus, the French Pat. No. 2,342,039 discloses a lining for footwear which comprises a pair of lateral pockets of which the opening consists of a median slit, each pocket being adapted to receive a padding element and an additional member of relatively incompressible material for adjusting the footwear to the wearer's foot size. However, though the padding can be introduced by the retailer, this operation is rather difficult for most unskilled persons and therefore it is preferable to fit the padding at the works, only the additional member of relatively incompressible material, preferably felt, being added by the retailer. Once the padding and the additional member are properly fitted in each pocket, it is difficult to remove them for replacing them with other elements, for example in case the wearer wished to increase the footwear tightness or when the same footwear is to be used by another person. Moreover, the two paddings and the two additional members, being independent of each other, are most liable to shift in their cavities. Furthermore, it is not possible to modify the padding of the back portion of the upper.

In the European Patent Application No. 0 004 829 it is contemplated to adapt the padding to the specific morphology of the wearer's foot by using a piece of thermoplastic foam which is heated on the wearer's foot. In a specific form of embodiment it is contemplated to use a one-piece thermoplastic element which is inserted into the side pockets openings to the rear so that it will surround the heel portion of the slipper upper and extend on either side thereof. In fact, the padding is held in position not only by the lateral pockets but also at the heel portion by the boot proper, whereby it is liable to shift and be damaged when the slipper is removed from the boot, for example for drying it. Neither is the padding properly held in position when fitting the slipper into the boot, and under these conditions it would be difficult to contemplate a practical application of this solution for fitting interchangeable paddings of a type other than the thermoplastic one.

SUMMARY OF THE INVENTION

It is the primary object of the present invention to avoid the inconveniences characterizing the prior art solutions and more particularly to provide an inner lining for a sports footwear having a rigid or semi-rigid shell structure, which comprises a one-piece interchangeable padding element, and such that the user may choose between a more or less stiff padding, change from one padding to another according to his specific requirements, and substitute a new padding for an old one without any difficulty, notably when the padding has undergone excessive compression, deformation and/or ageing, or permit the re-use of the footwear by another wearer and facilitate the repair of, and renovate, the slipper, and to have a really detachable slipper in which the padding is perfectly held in position.

For this purpose, the inner lining according to the present invention is characterized by the fact that the two lateral pockets extend on either side of the front portion of the lining, and that it comprises a substantially vertical opening at the rear; furthermore, the lining comprises a sheathing or outer lining covering the lower rear portion of the upper, the heel and the lateral rear portions of the two lateral front pockets, this outer lining being attached permanently to the upper through its upper edge and detachably, at least along its vertical edges, to the other portions of the inner lining, so as to cover the edges of the openings of the two front lateral pockets, the one-piece padding element being adapted to be detachably inserted under said sheathing and into the lateral pockets.

The sheathing or outer lining may be secured by using any suitably means, for example a VELCRO (Reg.Trademark) strip fastener. When the outer lining is secured in position, the slipper is perfectly closed and the padding perfectly held in position and protected, so that the inner lining or slipper can be removed and introduced several times from and into the footwear without any risk of damaging or shifting the padding. Nevertheless, the slipper can be opened instantaneously so as to free completely the rear lateral portions and the back portion of the upper, and also the padding which can thus be removed instantaneously and replaced with another padding of different shape, hardness, thickness or compressibility.

THE DRAWINGS

The attached drawing illustrates diagrammatically by way of example a typical form of embodiment of the invention.

DESCRIPTION OF THE PREFERRED EMBODIMENT

Figure 1:
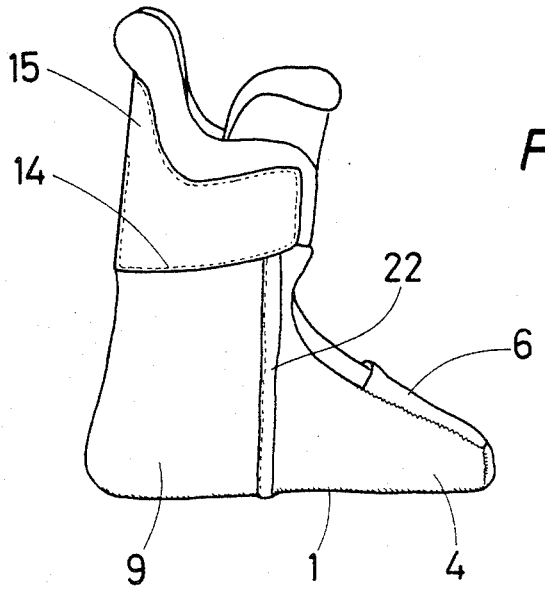
FIG. 1 is a side elevational view showing the inner lining in its closed condition.
Figure 2:
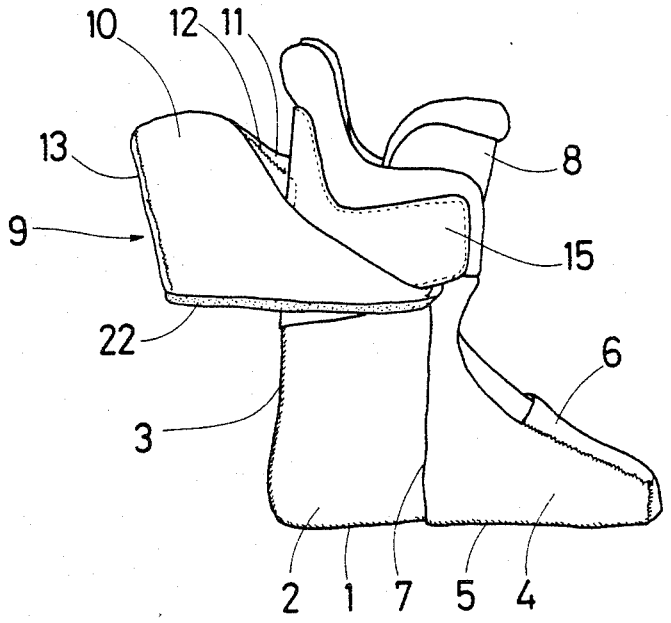
FIG. 2 is a similar view showing the same inner lining with the sheathing or outer lining somewhat lifted off.

The inner lining illustrated, which for the sake of convenience will be referred to as the "slipper" in the following disclosure, consists of a plurality of panels sewn together, each panel consisting of a synthetic knitted fabric bonded to a panel of synthetic material having preferably a cellular structure. These panels constitute a sole 1 and an upper. The upper includes an inner liner, formed by (two inner lateral panels such as 2 that are interconnected at the rear by a vertical seam 3 rising along the upper (see FIG. 2). The upper also includes an outer liner, disposed over the front portion of the inner liner, formed by a pair of outer panels such as 4 sewn to the sole 1 along their lower edges 5, and to a vamp-forming panel 6 along their upper edges. The vertical edges 7 of these panels 4 are free so as to constitute the opening of the two lateral pockets formed between the inner panels 2 and the outer panels 4. Secured to the vamp 6 is a semi-rigid tongue 8 adapted to cover the front portions of the leg and ankle. The slipper further comprises in its rear portion a sheathing or outer lining 9 consisting of a pair of lateral panels 10 and 11 assembled by a vertical central seam 12 and of a back panel 13 connected to the lower edges of the aforesaid pair of panels 10 and 11, all these panels being cut from the same material as the other panels so as to constitute a kind of pocket or cap adapted to wrap the heel of the footwear and cover the edges 7 of the front lateral pockets formed by the panels 4, as shown in FIG. 1. The sheathing 9 is secured along its upper edge by a seam 14 (FIG. 1) which ensures at the same time a reinforcing member 15 constituting the top portion of the upper.

Figure 3:
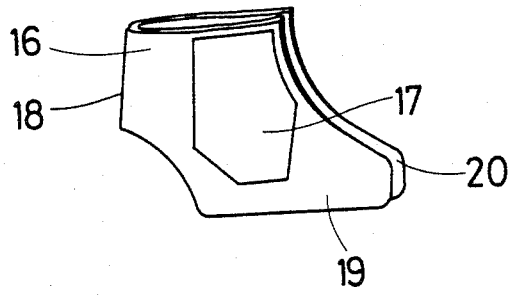
FIG. 3 is a similar view showing the padding before fitting same into the inner lining.

An exemplary form of embodiment of the padding is illustrated in FIG. 3. This one-piece padding consists of a cut panel 16 of multi-cellular plastic material, to which a pair of smaller panels such as 17, made from the same material as panel 16, or from a different material, are bonded. A panel similar to panel 17 may also be bonded to the inner surface of panel 16 in and on either side of the back fold 18 of the padding. The panel 16 and the panels bonded thereto may consist if desired of a more or less hard foam, and combined with other materials, compressible or not, such as felt or the like. The padding may also consist if desired of a multi-layer panel of heat-deformable material incorporating a heating element as disclosed in the European Patent Application No. 0 004 829. The padding comprises two portions 19 and 20 having in side-elevational view a show contour adapted to engage the two lateral front pockets of the slipper. In its unstressed condition, the padding is generally flat. Therefore, FIG. 3 illustrates the padding in its slightly prestressed condition, ready to be fitted to the slipper, as illustrated in FIG. 4.

Figure 4:
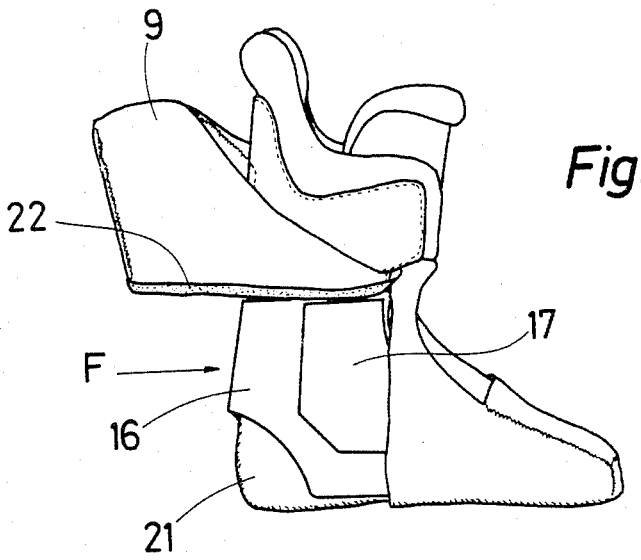
FIG. 4 is a side elevational view of the complete assembly, i.e. with the padding in position and before closing the sheathing.

To fit the padding in position it is only necessary to turn up the outer lining 9 and introduce the padding portions 19 and 20 into the two front lateral pockets of the slipper, as illustrated in FIG. 4. The outer lining 9 is then turned down around the heel 21 and fastened to the edges of the pair of lateral panels 4, and preferably also to the sole forming panel 1, by means of two VELCRO (Reg.Trade Mark) strips 22 stitched to the edges of the lining and adapted to engage and hook the knitted fabric constituting the panels 4 and sole 1.

Instead of a VELCRO fastener, any other suitable fastener may be used, for example a zipper or conjugate profiles fitting into each other through matching notches, or by bonding by using a reversible adhesive, i.e. an adhesive permitting the separation of the assembled sections by heating.

Finally, the slipper may of course be made from any other material and comprise a different number of panels sewn, bonded or welded to each other or preshaped.

What is claimed is:

1. An inner lining, for use in sports footwear of the type having a rigid or semi-rigid shell structure, said lining comprising an upper and a sole that are formed from a plurality of flexible panels assembled with one another, said sole including a heel portion and said upper comprising:

an inner liner having a front portion, a lower rear portion, and upper rear portion forming, along with said sole, a kind of slipper;

an outer liner disposed over the front portion of said inner liner to form a pair of lateral pockets extending on either side of said front portion, each pocket having a substantially vertical opening at the rear thereof; and a sheathing covering the lower rear portion of the upper, the heel portion of said sole and lateral portions of the upper behind the front lateral pockets, the sheathing having an upper edge and being fastened permanently to said upper at said upper edge, said sheathing further having vertical edges and means for detachably securing said vertical edges to said outer liner for covering said vertical openings; wherein said sheathing and lateral pockets define a space adapted to receive a padding member extending from one pocket, behind the upper, and into the other pocket; and wherein such a one piece padding member may be detachably inserted under said sheathing and into said lateral pockets to be retained thereby.

2. An inner liner as defined in claim 1, wherein said sheathing is formed by panels secured together to conform to the shape of the heel portion of the sole and of the lower rear portion and lateral portions of the upper covered thereby.

3. An inner lining as defined in claim 2, further comprising a padding member extending behind the rear portion of said upper beneath said sheathing, with opposite end portions received in the pair of lateral pockets.

* * * * *

UNITED STATES PATENT AND TRADEMARK OFFICE

CERTIFICATE OF CORRECTION

PATENT NO. : 4,523,392

DATED : June 18, 1985

INVENTOR(S) : Andrea Gabrielli

It is certified that error appears in the above-identified patent and that said Letters Patent is hereby corrected as shown below:

Column 2, line 67, "(two" should read --two--;

Column 3, line 21 "ensures" should read --secures--.

Signed and Sealed this

*Twenty-second* Day of *October 1985*

[SEAL]

*Attest:*

DONALD J. QUIGG

*Attesting Officer*

*Commissioner of Patents and Trademarks—Designate*